United States Patent [19]

Van John

[11] Patent Number: 4,538,802

[45] Date of Patent: Sep. 3, 1985

[54] ENERGY ALTERNATING SWING METHOD

[76] Inventor: John W. Van John, 2953 Waterfield Dr., Sparks, Nev. 89431

[21] Appl. No.: 273,331

[22] Filed: Jun. 15, 1981

[51] Int. Cl.[3] ..... A63F 9/00

[52] U.S. Cl. ..... 272/1 R; 272/85; 446/247; 434/302

[58] Field of Search ..... 272/1 R, 85, 8 N, 87, 272/88, 89, 90, 91; 297/273–281; 434/302, 300; 46/47, 51; 273/413, 61 R; 446/243, 247, 253

[56] References Cited

U.S. PATENT DOCUMENTS

| | | | |
|---|---|---|---|
| 1,481,075 | 1/1924 | Strouse | 434/300 |
| 3,521,848 | 7/1970 | Aase | 272/61 R |
| 3,702,699 | 11/1972 | Smith | 273/1 G |

OTHER PUBLICATIONS

"Welch Laboratory Apparatus", Mar. 1965, p. 181.

*Primary Examiner*—Richard C. Pinkham
*Assistant Examiner*—T. Brown
*Attorney, Agent, or Firm*—Herbert C. Schulze

[57] ABSTRACT

This invention is a method for transfering energy alternately between two moving, rotating and swinging objects, and includes a pair of objects suspended in close proximity to one another in such manner that the suspension means for the two items may be wrapped around one another, and is characterized by one object swinging in a large circle with its suspension means wrapping about that of the other while the other stands relatively still, and subsequently the second object, without external interference, commences a circular and swinging action on its own, bringing the first to rest, and wherein the two objects may transmit motion from one to the other in this manner repetitively.

1 Claim, 17 Drawing Figures

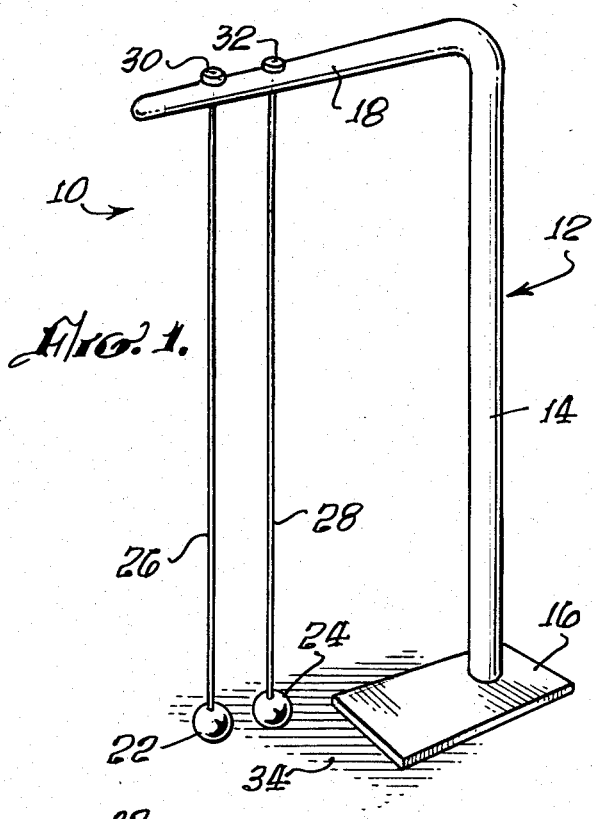
FIG. 1.
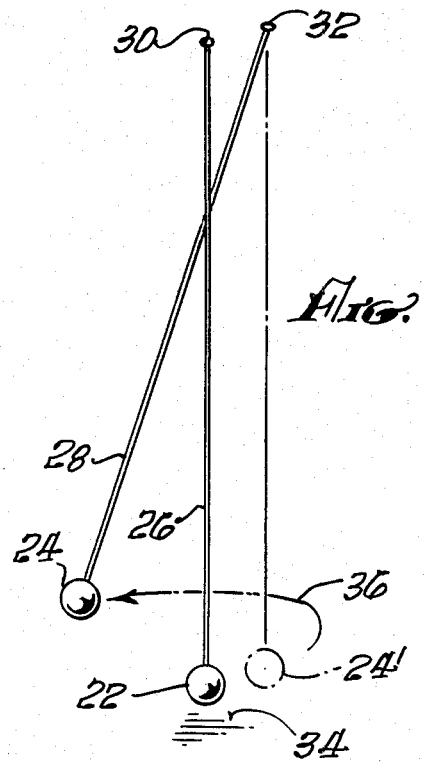
FIG. 2.
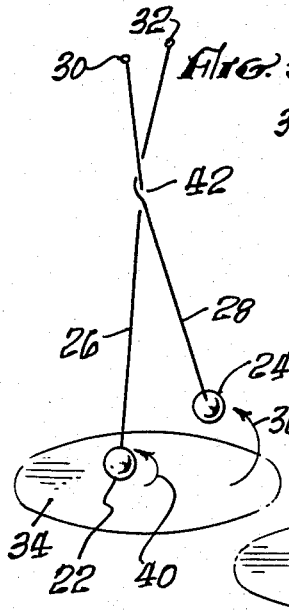
FIG. 3.
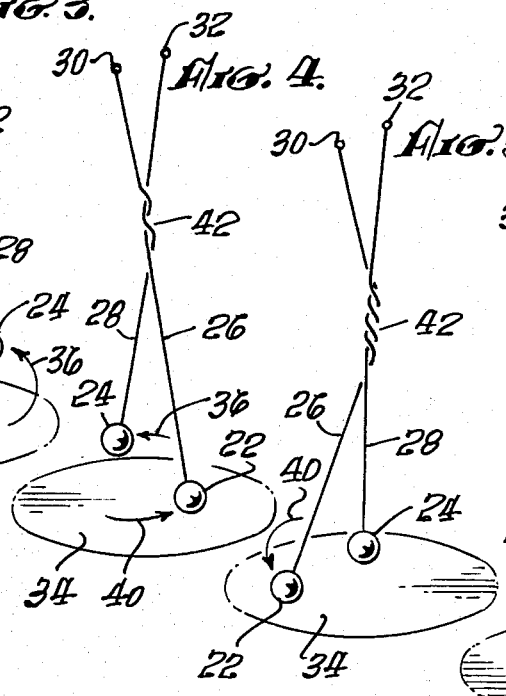
FIG. 4.
FIG. 5.
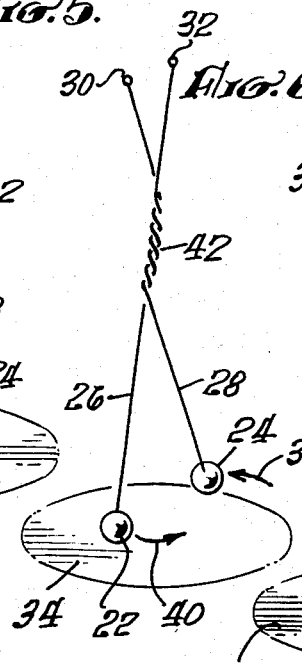
FIG. 6.
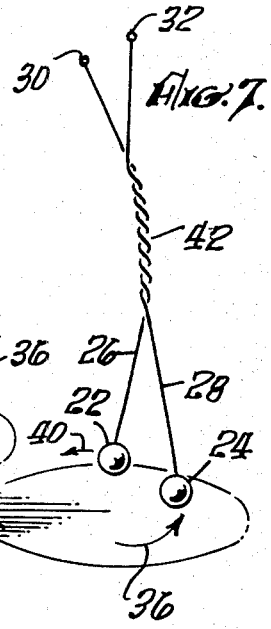
FIG. 7.

Forces Equalized

Forces Unequal

ENERGY ALTERNATING SWING METHOD

CROSS REFERENCE TO RELATED PATENT APPLICATIONS

There are no patent applications filed by me related to the present application except for a design patent application relating to this device being filed concurrently herewith.

BACKGROUND OF THE INVENTION

1. Field of the Invention

This invention is in the general field of swinging objects suspended by a suspending cord or the like and is more particularly directed to such devices where two swinging objects are suspended in proximity to one another in such manner that their suspension means would be wrapped around one another. The invention is even more particularly directed to such a device wherein there is a method for swinging one object about the other, wherein energy is transferred between the two such that the second object may ultimately acquire the momentum while the first one loses it and comes to rest. The invention is more particularly directed to a method utilizing such objects as have been mentioned for an entertainment device for children or other persons.

2. Description of the Prior Art

There is literally no prior art known to me having a bearing upon the present invention. There are many swings of various types known, and it is customary to swing heavy objects on the end of a cable or the like. For example, it is known to swing a heavy metal ball upon the end of a cord for purposes of demolishing buildings. Likewise, it is known for children to swing back and forth on a swing suspended for a pair of cords overhead.

The present invention, however, comprises the utilization of two swing-like objects, each suspended from a single point and in close proximity to one another, wherein they can be wrapped about one another. It further involves a method wherein one of the objects is first given momentum in a circular direction about the other object which is standing still, and the second object gradually takes from the first all of its momentum and action and brings it to rest while the second enters into an orbit about the first. In this respect the invention is completely unique and without prior art.

SUMMARY OF THE INVENTION

For a long period of time I have worked with swinging objects and particularly attempting to devise a different and exciting method and apparatus for inducing an unusual swinging and rotating motion to a pair of associated objects in such manner that motion from one will be transferred to the other and vice versa in a peculiar manner.

I have discovered that by placing two weighted objects in an appropriate inter-relationship to one another and suspending them in proximity to one another that if one is caused to commence an entwinement about the other object, a very strange and unique series of inter-relationships become accomplished. What occurs is that one object orbiting the other will cause an entwinement of the suspending apparatus of each and at a certain point the orbiting item will lose its orbiting motion and become still, with the object which was originally still becoming an orbiting object without any external application of force.

The entwinement and alternating orbiting of the items can continue for a long period of time upon one initial impulse being imparted.

By coloring the two objects and their supporting means with different and bright colors, a most unusual visual appearance is achieved which is fascinating and gives considerable pleasure.

Carrying the procedure a step further, I found that two persons suspended in this manner can in effect swing around each other with the transference of an orbiting motion from one to the other creating a most enjoyable recreation activity and creating a completely new and different swing type arrangement. There is no other motion in connection with any known swings for children or adults which approximates the unusual condition achieved in this manner.

By appropriately anchoring a pair of swing seats to an overhead beam or the like, a very inexpensive and most unusual entertainment device for children, particularly, is achieved in this manner.

It is an object of this invention to provide a method and means by which an object suspended from above may be made to orbit about another suspended object in such manner that the suspension means become entwined and the first object will transfer its orbiting motion to the other and will assume a quiet attitude and vice versa for a repeated number of times.

Another object of this invention is to provide a swing to be used by children and others to provide a unique, new entertainment motion and device.

The foregoing and other objects and advantages will become apparent to those skilled in the art upon reading the description of a preferred embodiment which follows in conjunction with a review of the appended drawings.

BRIEF DESCRIPTION OF THE DRAWINGS

FIG. 1 is a perspective showing the ENERGY ALTERNATING SWING APPARATUS of the invention;

FIG. 2 is a schematic perspective of the apparatus of FIG. 1 in a beginning mode of operation.

FIGS. 3 through 7 are schematic perspectives on a reduced scale showing continued motions evolved during the actuation of the principles of the invention;

DESCRIPTION OF A PREFERRED EMBODIMENT

Figure 8:
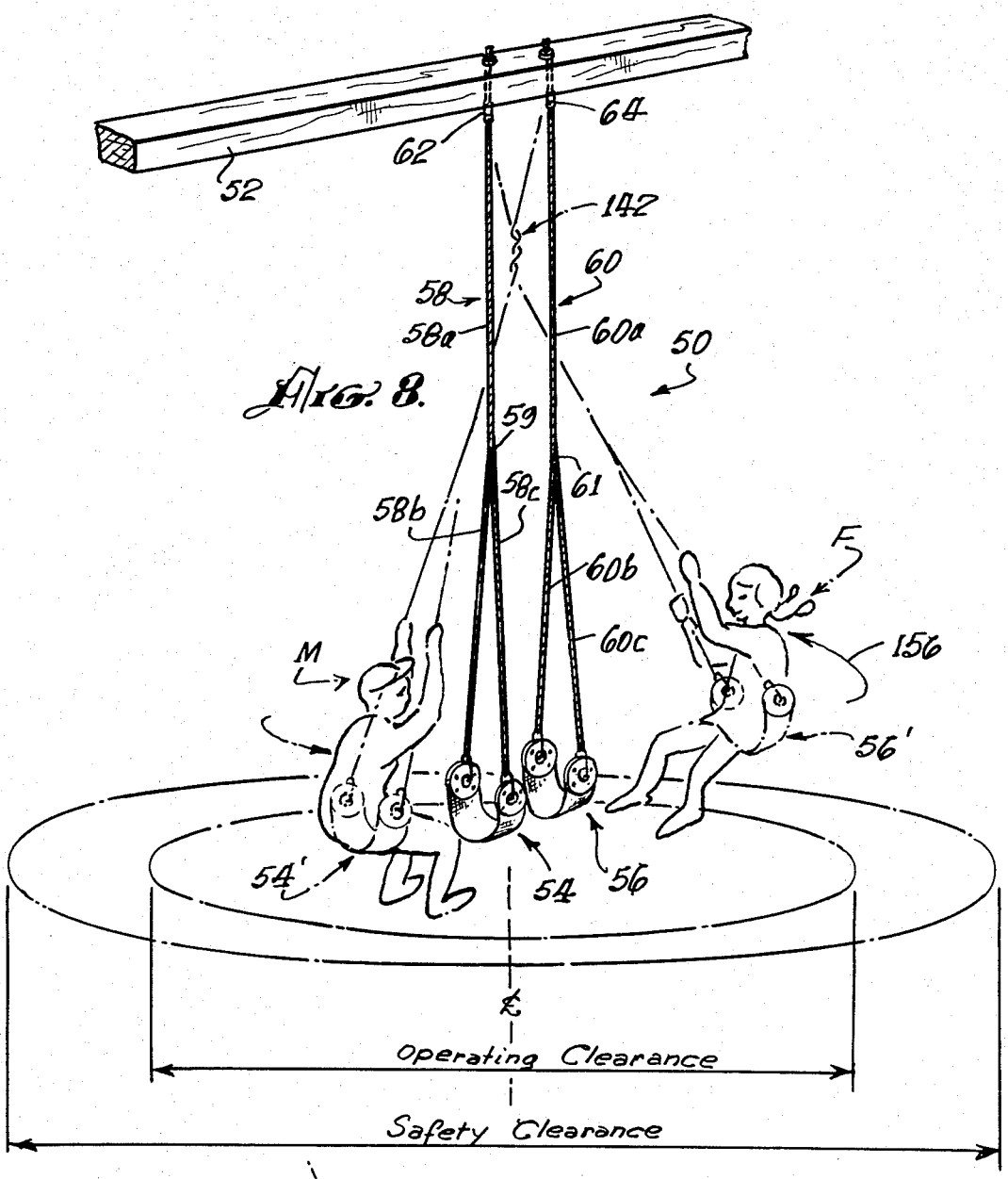
FIG. 8 is a perspective of a child's swing arrangement utilizing the principles of the invention.

I have illustrated in FIG. 1 a simplified version of a device for transferring energy alternately between two moving, rotating, and swinging objects. The assembly, as illustrated by the reference numeral 10 comprises a support structure 12 of conventional construction including a post 14, a base 16 and a cross arm support member 18. The suspension arrangement for supporting weights 22 and 24 at the ends of lines 26 and 28 at points 30 and 32, completes the items necessary for practicing my invention.

In FIG. 2, the weights, which in this case are shown as spherical members 22 and 24, are suspended slightly above a floor or ground surface 34. When one of the weights, in this instance, the sphere 24, is moved into an arcuate direction shown by the path 36, the action between the two suspended weights begins.

FIGS. 3 through 7 illustrate the fundamental procedure which takes place after a player or operator of the energy transferring device has started the sequences of operation. In FIG. 3 the weight 24 continues to move in an arcuate direction of the path 36 until a twisting of suspension lines 26 and 28 takes place at point 42. Further movement of sphere 24 along the path 36 begins to slightly transfer energy to the suspension line 26. The second sphere 22 at this time begins a slight arcuate movement along its circular path 40. The figure shows a further plurality of twists between the two suspension lines 26 and 28 and it can be seen that the circular motion of sphere 24 is diminishing and the circular motion of the sphere 22 is increasing into a larger circular radius. FIG. 5 illustrates a condition where the initial sphere 24 which had been in motion at the beginning has now become more or less stationary. Meanwhile, the weight 22, having received the transfer of energy from the inertial action of the revolving weight 24, now has assumed a large radius and moves in a circular direction about the stationary weight. The twisted portion 42 has now become a plurality of intertwining segments of both support lines 26 and 28. FIG. 6 shows the process now continuing to such a point that the energy is beginning to transfer back from the moving sphere 22 to the sphere 24. Finally, FIG. 7 shows the initiative being taken by the original sphere 24 and the process of transferring of energy alternately has continued. After the twisting of the two suspension lines 26 and 28 has reduced the circumferential paths of both spheres 22 and 24 to a point where the spheres have come into contact with each other, then the process is reversed as the two spheres begin to unwind and transfer energy between each other until the procedure has been completed to where the two suspension lines have been untwisted from one another.

The principle of this energy transferring method has uniquely been diverted by myself to the device illustrated in FIG. 8. In this instance, this same principle of weights being supported by suspension lines from a support means while slightly spaced from one another, can be utilized into an entertaining game of play.

A swing game is illustrated in FIG. 8 by the reference numeral 50. A support means, such as a beam 52, or any other structurally sound support means available to whomever is installing the game, supports a pair of swing seats 54 and 56. These seats may be of any conventional type used by children in playgrounds and homes. Suspension means 58 and 60 support the swings a short distance from the ground or surface at points 62 and 64. Two individuals, such as children M and F, can then sit into the swing seats and commence the game of play. One child, as for example the girl F, begins moving along the ground with her feet in a circular direction along the arrow 156 in either direction about the boy M. After starting the circular motion about the individual M, a twisting effect takes place at 142. As the child F continues to revolve around child M, the forces described in the first seven figures of the drawings take place in a similar manner and the children then commence to have an interchange of energy between themselves and the motion brought about becomes very entertaining to both parties.

The operation of the game, of course, is done within an "operating clearance" as indicated in FIG. 8 and is placed in an area where no obstructions are immediately in the vicinity anywhere within the area labeled "safety clearance".

The action is further enhanced by the suspension lines 58 and 60 as single lines 58*a* and 60*a* to points 59 and 61 and then splitting into a pair of support lines. Line 58 leaves line 58*a* at 59 and becomes a pair of lines 58*b* and 58*c*. Likewise, line 60 is a single line at 60*a* until it reaches point 61 and splits into lines 60*b* and 60*c*. These split lines can be grasped by the individuals in the seats 54 and 56 for better securement to remain within the seats. The procedure can be brought about wherein the boy M can be the initial starting force for the game.

Figure 9:
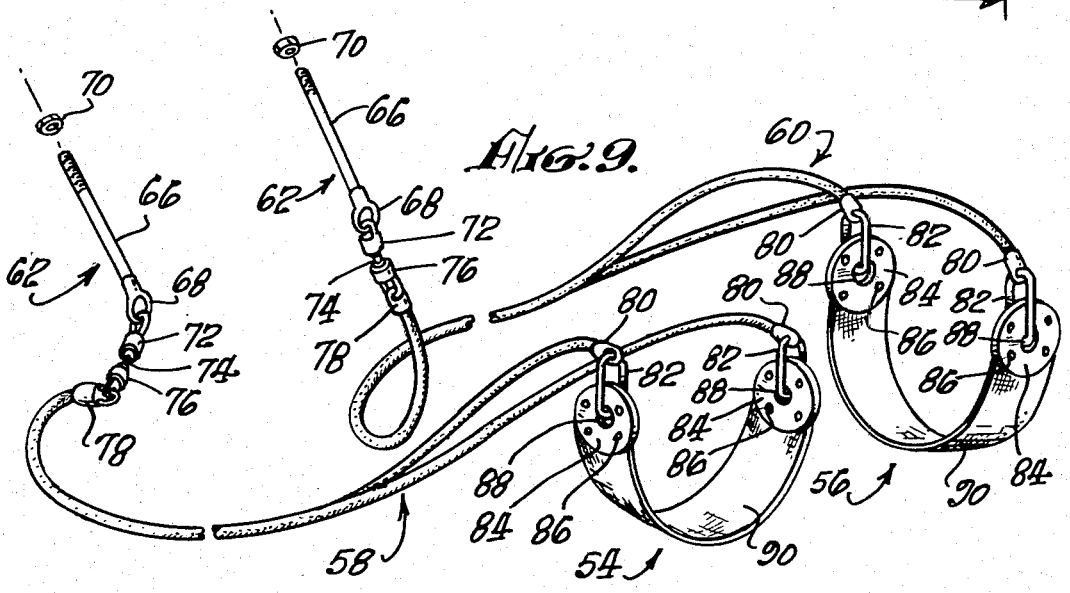
FIG. 9 is a perspective of the components used in the FIG. 8 configuration.

In FIG. 9 I have illustrated the components of the apparatus as seen in FIG. 8. The point of support for line 58 is shown at 62 as a threaded bolt 66 passing through an opening in the support beam 52 and fastened thereto by a nut arrangement 70. At its lower end, the bolt 66 has an eye 68. Secured to the eye is a connecting member 72 which is pivotally connected to a second connecting member 76 by means of a ball and socket arrangement 74. A cable connecting end 78 is secured to this lower member 76 and has a matching set of connectors 80 at the opposite end of the line 58. Only one of the lines is herewith described because the second line arrangement 60 is constructed in a similar manner. A link 82 connects the cable connecting member 80 to the seat assembly 54. A reinforcing portion 84 is fabricated at each end of the flexible seat by means of rivets 86, or the like. An opening 88 is provided through this reinforcing portion and allows the child to sit in the flexible band portion 90 of the seat 54 in a comfortable manner. Many types of playground swing seats are available on the current market and I will not attempt to limit myself to the particular construction shown.

Figure 10:
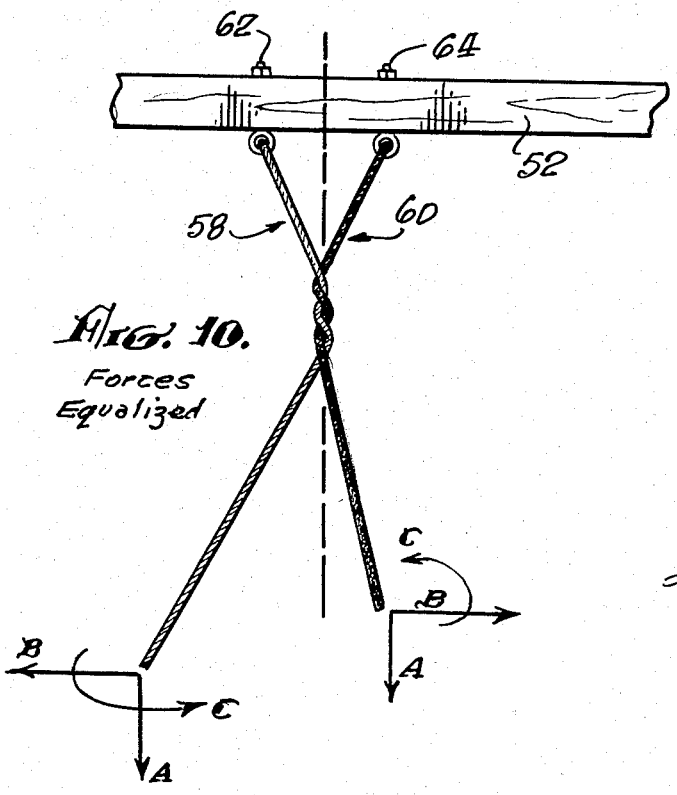
FIG. 10 is a simplified fragmentary side elevation showing forces involved in the process of using the methods of the invention.

FIG. 10 illustrates in a simplified manner that at a given time the forces A and B for each of the support lines has been equalized due to the weights of the individuals in the swings and the speed and radius of rotation of both of the objects.

Figure 11:
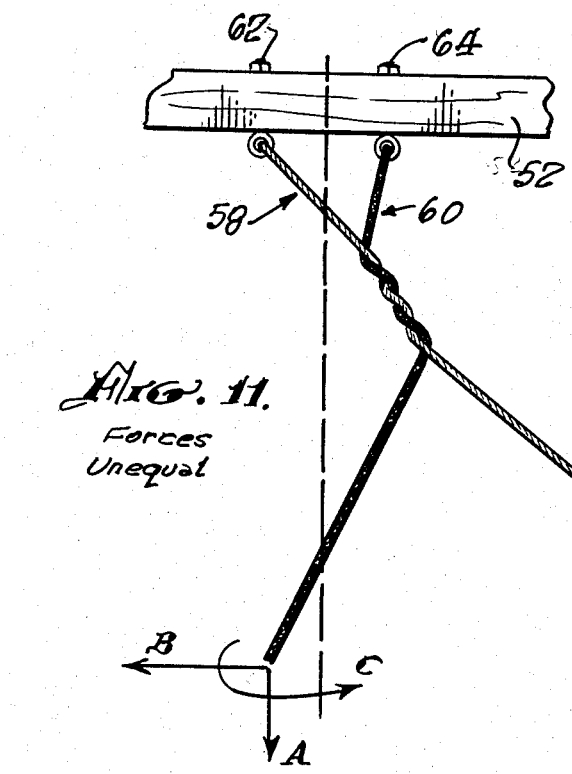
FIG. 11 is a view similar to FIG. 10 but showing a further condition of the forces indicated in FIG. 10.

FIG. 11 shows a simplified position wherein the suspension means located at the initial support point to the right of the center line has now come to have a smaller action of forces A and B about the rotation of axis C, as compared to the suspension means located to the left of the center line at its initial pivot point. It can be seen that a number of variables can come about because of the differences of forces applied and the weights of the objects being suspended. The cords can be of varying bright colors.

FIGS. 10 and 11 have just simply illustrated two conditions that might prevail during the play of this game.

Figure 12:
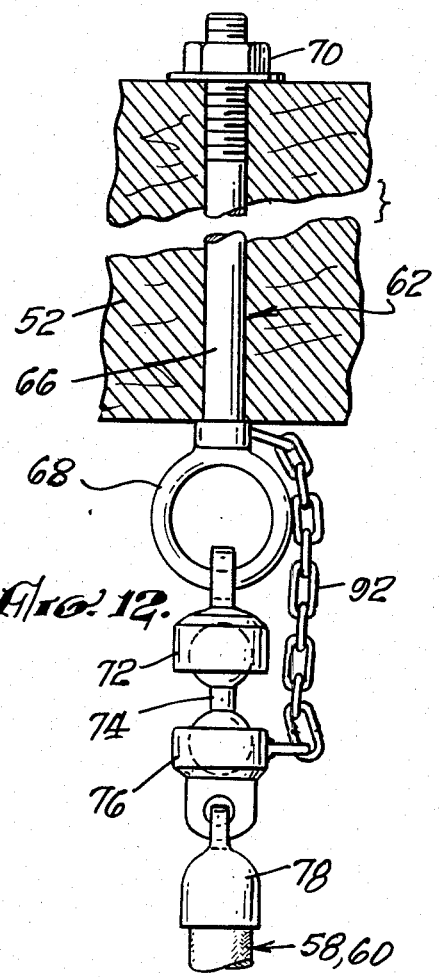
FIG. 12 is an enlarged fragmentary section partly in elevation showing a support means for the suspension apparatus of the invention.

FIG. 12 shows on an enlarged scale the support means illustrated in FIGS. 8 and 9. A chain connection 92 is shown as having been secured to the lower swivel connector 76 and to the eye portion 68 of the bolt 66, in order to prevent excessive rotation of support line 58 in relation to the upper support combination.

Figure 13:
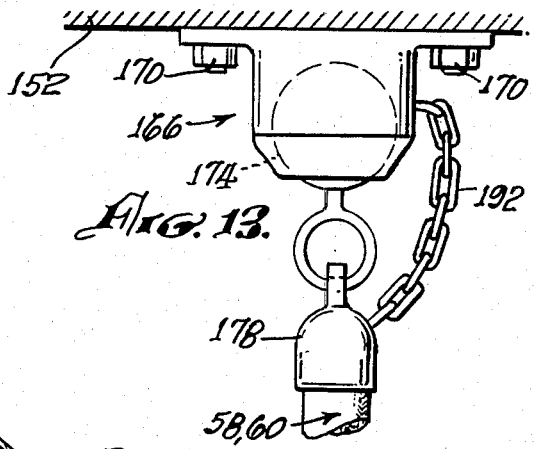
FIG. 13 is a fragmentary side elevation of an alternate embodiment of support means.

FIG. 13 shows an alternate embodiment of swivel support means 166 mounted by fasteners 170 to a support beam 152. A swivel connection 174 supports the cord end member 178 in a manner similar to that of FIG. 12. Chain connection 192 keeps excessive movement from occurring between the suspension cord and the upper support assembly.

Figure 14:
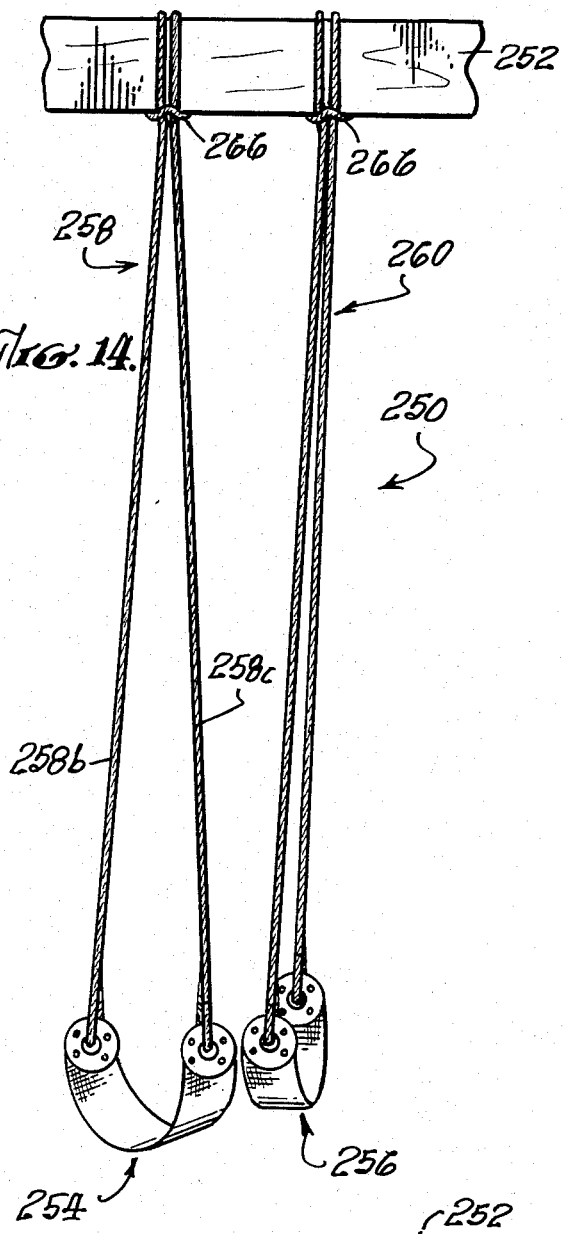
FIG. 14 is a perspective of a child's swing arrangement showing an alternate method of construction.
Figure 16:
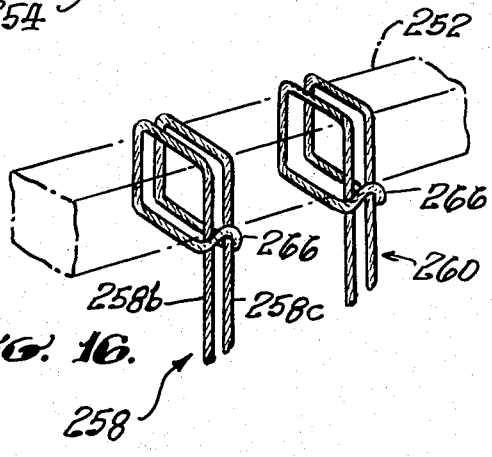
FIG. 16 illustrates a method of looping the suspension means of FIG. 14.

Many variations of swing support apparatus can be constructed. One form is shown in FIGS. 14 and 16. In this case the overall assembly 250 comprises a support beam 252 to which suspension means 258 and 260 support seats 254 and 256. Individual segments 258b and 258c are shown being looped around the support beam 252 and surround the downwardly depending portions of the suspension lines 258 and 256 at 266.

Figure 17:
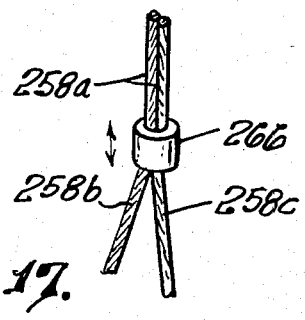
FIG. 17 is a fragmentary perspective showing a means for varying the length of the suspension means of FIG. 16.

FIG. 17 shows the suspension means of FIGS. 14 and 16 as being altered by the addition of a member 266 being applied to surround the individual lines 258*b* and 258*c*. As this member 266 is moved to a different position as indicated in FIG. 17, the upper portion of the support means 258 becomes a single line, in essence, 258*a*. In this manner, a single line, in essence, can be formed at the upper end of the supports 258 and 260. By moving this device 266 up or down, a support means for the seats 254 and 256 can be altered.

Figure 15:
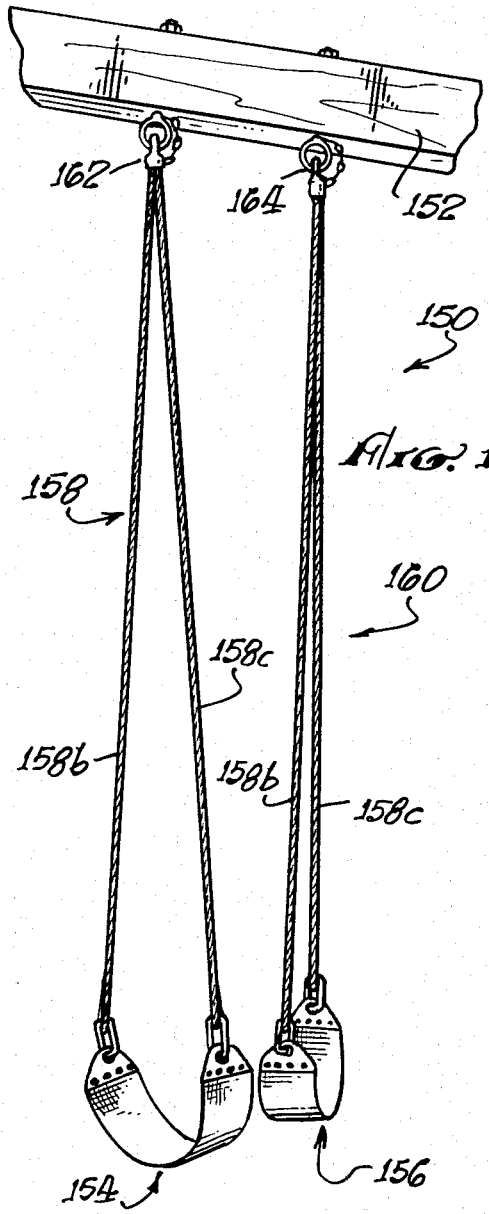
FIG. 15 is an alternate embodiment of swing support.

FIG. 15 shows a support beam 152 supporting the swing structure 150. This alternate embodiment is shown as having the support lines 158 and 160 as being supported at 162 and 164 in such a manner that the individual segments 158*b* and 158*c* meet at a common point along with segments 160*b* and 160*c*. The belt-like seat members are shown with a different type of reinforcement at their outer ends than that illustrated in FIGS. 8 and 9. The seats 154 and 156 are used in a similar manner to that shown in FIG. 8.

It is to be understood that the seats can be of a bucket-form or of flat board construction. The lines supporting the seats are easily constructed from materials available on the market such as nylon cord, or the like.

While I have shown embodiments of this invention and have described methods that are fully capable of achieving the objects and advantages desired, it is to be understood that such emobodiments are for the purposes of illustration only and not for the purposes of limitation.

I claim:

1. The method of transmitting energy and motion between two suspended objects comprising: fastening a first object having a given weight and shape to the first end of a first elongated flexible suspension means having two ends; fastening the second end of the said first suspension means to a first position on a fixed suspension device at a distance above a base level; fastening a second object having the same weight and shape as the first object to the first end of a second elongated flexible suspension means which is a duplicate of the first suspension means; fastening the second end of said second suspension means to a second position on said fixed suspension device in such manner that the two objects are at the same elevation above the base level and the two suspension means are parallel and in close proximity to each other; imparting a freely moving circular motion to the first object in such manner that the first object circles about the second suspension means while the second object is unrestricted and remains essentially at rest, in such manner that in so circling, the first object cause the first suspension means to encircle and entwine the first suspension means about the second suspension means; causing the first object to cease its circular motion naturally, and without interference exterior to the two object and the two suspension means and the suspension device; causing the first object to move in a circular motion opposite to its original circular motion without interference exterior of the two objects, the two suspension means, and the suspension device, and in so doing causing the first suspension means to become disentwined from about the second suspension means; causing the first object to come to rest in its original position of rest prior to its first motion by its natural action and without interference exterior the two objects, the two suspension means, and the suspension device; and causing the second object to commence a circular motion about the first suspension means without any influence exterior the two objects, two suspension means, and the suspension device in such manner that the second suspension means becomes entwined about the first suspension means by means of a naturally induced circular motion of the second object without influence exterior the two objects, the two suspension means, and the suspension device.

* * * * *